United States Patent [19]

Kirchoff et al.

[11] 4,117,284

[45] Sep. 26, 1978

[54] SUBMINIATURE, THREE POSITION, SWITCH WITH NON-SLIDING ROCKER CONTACT

[75] Inventors: Francis D. Kirchoff, Waban; Ellis K. Washburn, Tewksbury, both of Mass.

[73] Assignee: Alco Electronic Products, Inc., North Andover, Mass.

[21] Appl. No.: 718,521

[22] Filed: Aug. 30, 1976

[51] Int. Cl.[2] ..... H01H 13/00

[52] U.S. Cl. ..... 200/67 G; 200/68

[58] Field of Search ..... 200/67.7, 67 G, 68, 200/77

[56] References Cited

U.S. PATENT DOCUMENTS

| | | | |
|---|---|---|---|
| 3,581,033 | 5/1971 | Plumb | 200/67 G |
| 3,604,868 | 9/1971 | Batcheller | 200/67 G |
| 3,670,116 | 6/1972 | Cryer | 200/67 G |
| 3,746,359 | 7/1973 | Lewis | 200/67 G |

*Primary Examiner*—Samuel W. Engle
*Assistant Examiner*—Ralph Palo
*Attorney, Agent, or Firm*—Pearson & Pearson

[57] ABSTRACT

A subminiature, three position switch has a rocker, or see-saw, moveable contact which is free of conventional side tabs and tab guides, these being precluded by the limited space available. Instead, the rocker arm is of uniform cross section except for a pair of lateral grooves in the under face, each on an opposite side of a central depression, for the tip of the actuator rod. A U-shaped support means, electrically connected to the common central terminal, has a pair of upstanding, legs, or blades, each arranged to be received in one of the grooves to prevent longitudinal sliding of the contact arm, when tilted.

10 Claims, 4 Drawing Figures

SUBMINIATURE, THREE POSITION, SWITCH WITH NON-SLIDING ROCKER CONTACT

BACKGROUND OF THE INVENTION

Three position toggle switches having ON-OFF-ON positions and including a case, a spring plunger actuator rod, a see-saw moveable contact, a common central terminal and a pair of end contact terminals are old and well known. Usually the moveable rocker, or see-saw, contact has been provided with a pair of laterally extending integral tabs, the tabs fitting in vertical groove side guides so that the contact arm may rock but is prevented from lateral or longitudinal movement.

Such a rocker arm is shown supported between the longitudinally extending legs of a V-shaped cradle in Italian Pat. No. 593,175 to Turatti on Aug. 6, 1958, there being integral tabs which extend laterally into a central space between the two side posts of the longitudinal uprights.

A similar support means for a see-saw rocker arm is disclosed in U.S. Pat. No. 3,694,598 to Nishikawa et al. on Sept. 26, 1972, there being a pair of such contact arms, each having laterally extending side tabs captive in vertically extending grooves in the side walls of the case.

SUMMARY OF THE INVENTION

It has been found that while lateral tabs are satisfactory for miniature three position switches, the space demands of much smaller switches known a sub-miniature switches, preclude the use of the side tabs or the side wall grooves of the prior art.

On the other hand the function of the tabs and side wall grooves must be retained because a moveable, rocker arm in a three position switch tends to slide longitudinally and climb up the inside walls of the case when tilted by a spring plunger actuator rod. The rocker arm must be supported in a cradle if it is to have a central "OFF" position.

If only a U-shaped cradle was provided to support the contact arm, it may tend to slip out of the cradle, with each tilt by the rod, perhaps because it is so small. It should be noted that the rocker, or moveable contact, of the invention is about 1/16 of an inch in width and about 4/16 in length so that precision manufacture, handling, installation and operation thereof all present unusual problems not encountered with components which can be easily stamped out, handled with the fingers and manually inserted in place in a case.

The minute, sub-miniature moveable contact of the invention therefore saves space by having a pair of laterally extending grooves of predetermined width, each on an opposite side of a central depression for the actuator rod, and each in the underface of the moveable contact. These grooves cooperate with each of a pair of upstanding, laterally extending legs, or blades, of a U-shaped cradle support.

Preferably each groove includes a right angular shoulder at the outer end and preferably each groove has a predetermined clearance relative to each leg.

Thus the moveable contact is of uniform cross-section, free of sidewise tabs, except for the lateral grooves in the lower face and the upstanding legs of the support, each enter a groove as the contact is tilted to prevent any longitudinal sliding, any tendency to slip out of the support and any tendency to climb the walls of the case.

DESCRIPTION OF A PREFERRED EMBODIMENT

Figure 1:
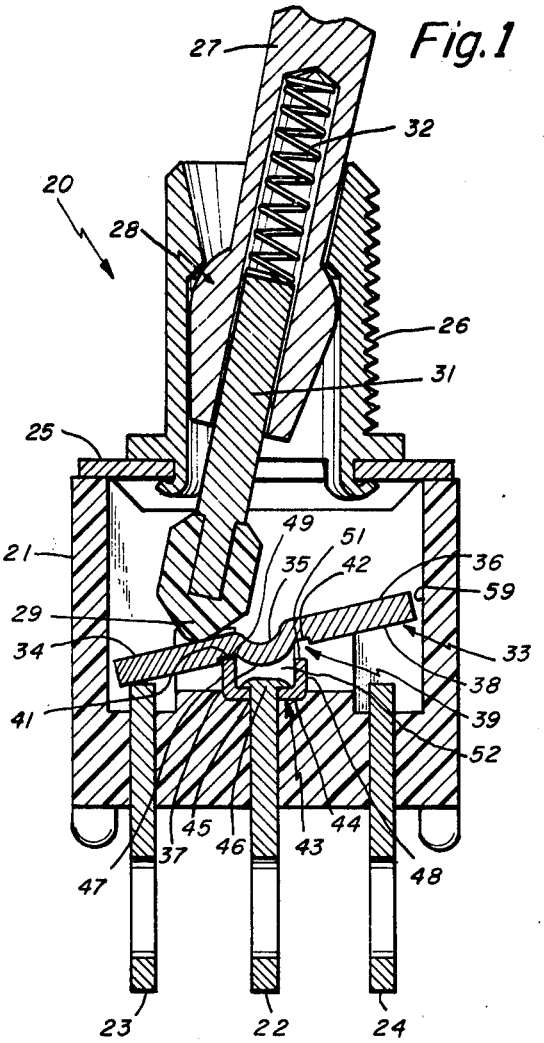
FIG. 1 is a side elevational view in half section of a three position switch constructed in accordance with the invention.
Figure 2:
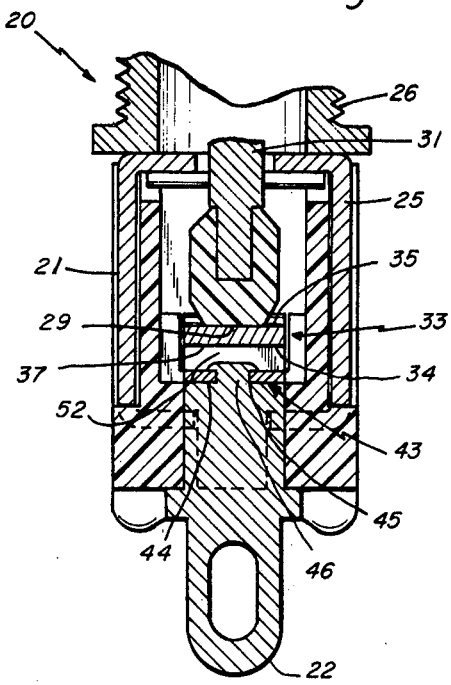
FIG. 2 is a front elevational view, in half section, of the switch shown in FIG. 1 but with the rocker in central "OFF" position.
Figure 3:
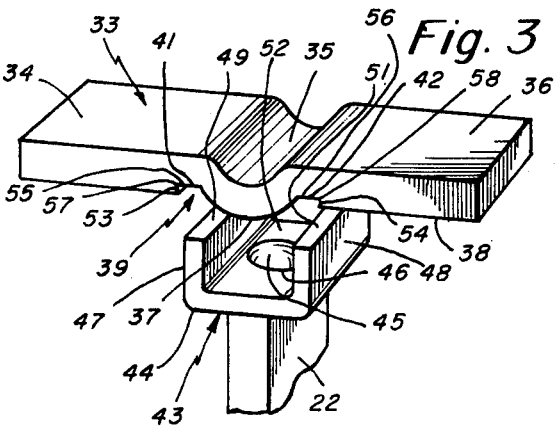
FIG. 3 is an enlarged perspective view of the improved rocker and rocker support of the invention and FIG. 4 is a side elevation on a reduced scale, of a subminiature switch of the invention, but greatly enlarged as far as actual switch dimensions are concerned.
Figure 4:
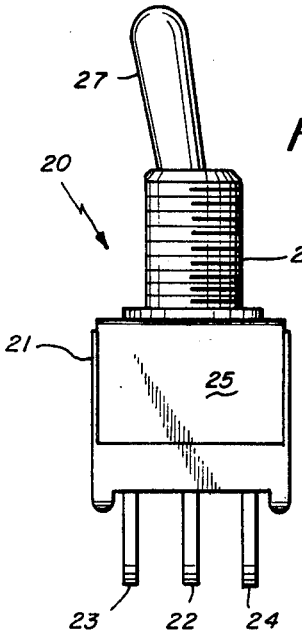

In the drawing a subminiature, three position switch 20 is shown, having a switch box, or case, 21, a common central terminal 22 and a pair of opposite end terminals 23 and 24. The switch box 21 is usually of plastic with a sheet metal cover 25, there being a frame assembly 26 crimped therein and upstanding therefrom. A toggle type actuator rod 27, is pivotable at 28, in the assembly 26 and includes a toggle tip 29 on the end of a plunger 31 resiliently urged outwardly by coil spring 32. As shown in FIG. 2 toggle tip 29 is not only rounded but extends laterally to form a relatively wide blade.

Rocker means 33 of the invention comprises an elongated moveable contact 34, (sometimes called a rocker or see-saw), the moveable contact 34 differing from those of the prior art in being free of any laterally extending integral support tabs, or wings. Moveable contact 34 includes a half-cylindrical, central, laterally-extending groove, or depression 35 for receiving the toggle tip 29 in the central "OFF" position of the ON-OFF-ON switch 20. The depression 35 in the upper face 36 of the contact 34 forms a corresponding downwardly depending rib 37 in the under face 38 of the contact 34.

Recess means 39 is provided in the under face 38 of contact arm 34, preferably in the form of a pair of laterally extending grooves 41 and 42, each on an opposite side of the rib 37.

The support means 43 for the moveable contact 34 is a U-shaped support 44 affixed at the bight portion 45 to the inside end 46 of the common central "OFF" terminal, the support 44 being of electrically conductive material. The U-shaped support 44 includes a pair of upstanding legs, or blades, 47 and 48 integral with the bight portion 45 and terminating in the laterally extending upper edges 49 and 51. The legs 47 and 48 are each on an opposite side of the depression 35 and rib 37, the rib depending into the space 52 between the legs and each upper edge 49 and 51 being positioned directly under one of the grooves 41 or 42.

Each groove 41 or 42 preferably includes an outer wall 53 or 54 normal to its bottom wall 55 or 56 to form a right angular shoulder 57 or 58 therewith. Each rocker arm is minute and about 4/10 of an inch long and about 1/10 of an inch wide, the grooves 41 and 42 being about 15/1000 of an inch in width and the upper edges 49 and 51 of the legs 47 and 48 are about 10/1000 of an inch in thickness to provide a predetermined clearance.

It will be seen that the moveable contact 34 cannot climb up the inside wall such as 59 of the case 21 when the contact 34 is tilted because in each opposite ON position an edge 49 or 51 is received in a groove 41 or 42 in rear of a shoulder 57 or 58 which restrains longitudinal movement.

By locating the non-sliding elements of the invention under the moveable contact arm rather than on each opposite side thereof, the contact arm may occupy the entire chamber and may be in as reduced dimensions as is possible to perform the ON-OFF-ON function of the switch 20.

We claim:

1. A subminiature, three position, switch of the type having a switch box, a moveable see-saw contact, a central common terminal, a pair of opposite end terminals and a spring plunger actuator rod for rocking said see-saw contact into ON-OFF-ON positions, said switch characterized by a U-shaped support in electrically conductive contact with the inside end of said central, common terminal; said support having a pair of upstanding legs, separated by a space, each leg having an upper edge on an opposite side of said common terminal and free of tab guides;

said moveable, see-saw contact having a central, laterally extending, half-cylindrical groove therein, for receiving the tip of said actuator rod in central OFF position;

said moveable contact having a rib, corresponding to, and opposite to, said groove, on the under face thereof, extending into the space between said legs and, said contact being free of integral, laterally extending side tabs and having a pair of laterally extending grooves, in the said under face thereof; each located above one of the said upstanding legs of said U-shaped support for receiving the same when said moveable contact is tilted into ON position on that side of said common terminal.

2. A combination as specified in claim 1 wherein:

each said laterally extending groove in the under face of said moveable contact includes an outer wall forming a right angular shoulder with the bottom wall of said groove.

3. In a subminiature, three position switch, the combination of:

a switch box, a pair of contact terminals, each on an opposite side of a central common contact terminal, a see-saw moveable contact free of integral, laterally extending side tabs and having an upper face with a central laterally extending groove and a lower face;

support means for said moveable contact, electrically connected to said central common terminal and including a pair of upstanding legs, free of upstanding guides for side tabs, each leg on an opposite side of said common terminal to form a space therebetween and each having a laterally extending upper edge;

and recess means in the lower face of said moveable contact member, cooperable with the said upper edges of said support for preventing sliding of said contact member longitudinally in said case.

4. A combination as specified in claim 3 wherein:

said support means is of U-shape, the bight portion thereof being fixed to the inside end of said common, central terminal.

5. A combination as specified in claim 3 wherein:

said recess means comprises a pair of laterally extending grooves, each extending laterally on the under face of said moveable contact, above the adjacent upper edge of one of the upstanding legs of said support means for receiving the said edge when said contact is tilted downwardly there onto.

6. A combination as specified in claim 5 wherein:

the upstanding legs of said support means are each about 10/1000 of an inch in thickness, and the grooves in the under face on said moveable contact member are about 15/1000 of an inch in width to provide a predetermined clearance therebetween.

7. In a subminiature toggle switch of the three position type:

an elongated straight, flat see-saw moveable contact of uniform cross section, free of central, sidewise-extending support tabs, said contact having an upper face with a central depression for receiving a toggle tip and having a lower face with a pair of laterally-extending grooves, each on an opposite side of said depression and, a pair of laterally-extending upstanding legs, each on an opposite side of, and electrically connected to, the common, central terminal of said switch, said legs being free of guides for side tabs and the upper edge of each said leg being received in the adjacent groove in said moveable contact when said contact is tilted downwardly thereonto, to prevent unwanted longitudinal sliding movement of said contact.

8. A subminiature toggle switch of the three position type having a central common terminal, a pair of end terminals, a spring plunger actuator rod and a see-saw contact arm, said switch characterized by:

an elongated rocker arm, free of sidewise-extending support tabs, said arm having an under face with a pair of laterally extending grooves, each on an opposite side of the center thereof;

and a U-shaped support attached to said common central terminal, said support having a pair of integral, upstanding, legs, or blades, free of guides for support tabs and each located to be received in one of said grooves when said contact is tilted downwardly to prevent undue longitudinal sliding movement of said moveable contact.

9. A combination as specified in claim 8 wherein:

each said groove in the under face of said moveable contact terminates at its outer end in a right angular shoulder.

10. A combination as specified in claim 8 wherein:

each said groove is of a predetermined width and, each said upstanding leg is of a predetermined lesser width, to provide a predetermined clearance there between.

* * * * *